US009920990B2

(12) United States Patent
Poy et al.

(10) Patent No.: US 9,920,990 B2
(45) Date of Patent: Mar. 20, 2018

(54) LAUNDRY PRESS APPARATUS AND METHOD

(75) Inventors: Russell H. Poy, New Orleans, LA (US); Chris Kulakowski, New Orleans, LA (US)

(73) Assignee: PELLERIN MILNOR CORPORATION, Kenner, LA (US)

( * ) Notice: Subject to any disclaimer, the term of this patent is extended or adjusted under 35 U.S.C. 154(b) by 1440 days.

(21) Appl. No.: 13/552,387

(22) Filed: Jul. 18, 2012

(65) Prior Publication Data

US 2013/0025151 A1 Jan. 31, 2013

Related U.S. Application Data

(60) Provisional application No. 61/511,791, filed on Jul. 26, 2011.

(51) Int. Cl.
*F26B 9/04* (2006.01)
*D06F 47/02* (2006.01)

(52) U.S. Cl.
CPC ..... *F26B 9/04* (2013.01); *D06F 47/02* (2013.01)

(58) Field of Classification Search
CPC ..... D06F 47/02; F26B 9/04
See application file for complete search history.

(56) References Cited

U.S. PATENT DOCUMENTS 1,359,745 A 11/1920 Reilly
1,671,913 A * 5/1928 Troy ..... D06F 47/04 68/241
1,738,326 A 12/1929 Smith
1,893,190 A 1/1933 West
2,142,202 A 1/1939 Mckay
2,531,890 A 11/1950 Pearson
(Continued)

FOREIGN PATENT DOCUMENTS

DE 102006030629 5/2007
EP 0143409 6/1985
(Continued)

OTHER PUBLICATIONS

Machine Translation of SU 789283 to Birbraer, Dec. 1980.*
(Continued)

*Primary Examiner* — Michael E Barr
*Assistant Examiner* — Benjamin L Osterhout
(74) *Attorney, Agent, or Firm* — Garvey, Smith & Nehrbass, Patent Attorneys, L.L.C.; Charles C. Garvel, Jr.; Vanessa M. D'Souza

(57) ABSTRACT

A press for pressing batches of fabric articles to remove excess fluid therefrom utilizes a specially configured frame having upper and lower plates. The frame supports a vessel having an interior that receives a batch of fabric articles therein. A press having a ram and a disk is supported at the lower end portion of the ram. The disk engages an upper surface portion of the batch of articles. The ram and disk move between upper and lower positions, the lower position being a pressing position that engages the disk with the fabric articles. The frame includes a plurality of rods that connect to the upper and lower plates, spacing the plates apart. The rods each have upper and lower end portions, each with a diameter that is larger than the diameter of a central portion of said rod that is positioned in between the upper and lower plates.

31 Claims, 9 Drawing Sheets

(56) References Cited

U.S. PATENT DOCUMENTS

| | | | | | |
|---|---|---|---|---|---|
| 2,538,290 | A | * | 1/1951 | Bernhardt | D06F 33/02 68/12.14 |
| 2,586,292 | A | * | 2/1952 | Berger | D06F 47/04 100/229 R |
| 2,611,257 | A | * | 9/1952 | Kahn | D06F 47/00 68/120 |
| 2,711,642 | A | * | 6/1955 | Meyer | D06F 47/04 100/127 |
| RE24,257 | E | | 12/1956 | Kahn | |
| 3,071,878 | A | | 1/1963 | Beasley | |
| 3,256,721 | A | * | 6/1966 | Meyer | B30B 9/04 100/218 |
| 3,460,363 | A | * | 8/1969 | Grantham | D06F 47/04 100/127 |
| 3,872,695 | A | * | 3/1975 | Busek | C14B 1/00 100/118 |
| 3,908,413 | A | | 9/1975 | Meyer | |
| 3,924,425 | A | | 12/1975 | Arendt | |
| 4,180,995 | A | | 1/1980 | Meyer | |
| 4,452,056 | A | | 6/1984 | Files | |
| 4,471,637 | A | | 9/1984 | Holzinger | |
| 4,525,935 | A | | 7/1985 | Stuhmeier | |
| 4,574,599 | A | | 3/1986 | Pellerin | |
| 4,676,079 | A | | 6/1987 | Czauderna | |
| 4,676,154 | A | * | 6/1987 | Steinort | D06F 47/00 100/116 |
| 4,753,089 | A | | 6/1988 | Engel | |
| 4,976,119 | A | * | 12/1990 | Hartmann | D06F 47/00 100/116 |
| 5,001,911 | A | | 3/1991 | Eck | |
| 5,065,535 | A | | 11/1991 | Gill | |
| 5,331,755 | A | | 7/1994 | Kwok | |
| 5,333,352 | A | * | 8/1994 | McDonald, Jr. | D06F 47/02 100/112 |
| 5,970,637 | A | | 10/1999 | Mohan | |
| 2004/0069021 | A1 | * | 4/2004 | Bringewatt | B30B 5/02 68/21 |
| 2010/0313440 | A1 | | 12/2010 | Poy et al. | |

FOREIGN PATENT DOCUMENTS

| | | |
|---|---|---|
| GB | 2158466 | 11/1985 |
| JP | 49-046375 | 7/1972 |
| JP | 2008-051269 | 3/2008 |
| JP | 2009-063162 | 3/2009 |
| JP | 2009291499 | 12/2009 |
| SU | 387156 | 10/1973 |
| SU | 789283 | 12/1980 |

OTHER PUBLICATIONS

Nord-Lock Q&A page to Kingsley Tang, Mar. 2015.*

P.I.ORLOV. Osnovy konstruirovania. "Izdatelstvo Mashinostroenie", Moscow, 1968, p. 407-408.

* cited by examiner

LAUNDRY PRESS APPARATUS AND METHOD

CROSS-REFERENCE TO RELATED APPLICATIONS

In the US, this is a non-provisional application of U.S. Provisional Patent Application Ser. No. 61/511,791 filed 26 Jul. 2011.

Priority of U.S. Provisional Application Ser. No. 61/511,791, filed 26 Jul. 2011, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved apparatus for pressing fluid (e.g., rinse water) from fabric articles (e.g., laundry). More particularly, the present invention relates to a method and apparatus for pressing fluid from laundry articles wherein the press frame has a specially configured tie rod arrangement with improved fatigue performance.

2. General Background of the Invention

Laundry presses remove water from washed linen by hydraulically applying pressure. This force is developed by pressurizing a hydraulic ram pressing down on linen held in a pressure vessel. The water is pushed out of the linen into a slotted or apertured plate under the linen. The following patents (each incorporated herein by reference) relate generally to laundry presses and like devices.

TABLE

| PATENT NO. | TITLE | ISSUE DATE MM-DD-YYYY |
|---|---|---|
| 1,359,745 | Ironing Machine | 11-23-1920 |
| 1,893,190 | Ironing Machine | 01-03-1933 |
| 2,142,202 | Ironing and Pressing Machine | 01-03-1939 |
| 2,531,890 | Indexing and Lock Mechanism | 11-28-1950 |
| RE 24,257 | Combined Washing and Squeeze Drying Machine | 12-18-1956 |
| 3,071,878 | Ironing Machine | 01-08-1963 |
| 3,908,413 | Pressing Apparatus for the Pressure Extracting of Liquid | 09-30-1975 |
| 3,924,425 | Presses for Washing | 12-09-1975 |
| 4,180,995 | Pressing Apparatus for Squeezing Laundry and the Like | 01-01-1980 |
| 4,452,056 | Liquid Extracting Apparatus | 06-05-1984 |
| 4,471,637 | Apparatus for Dewatering Items of Washed Laundry | 09-18-1984 |
| 4,525,935 | Method for Dewatering Items of Washed Laundry | 07-02-1985 |
| 4,574,599 | Apparatus for Pressing Liquid from Cloth Goods | 03-11-1986 |
| 4,676,079 | Appliance for Draining Washed Laundry Articles | 06-30-1987 |
| 4,753,089 | Water-Removal Press for Textiles | 06-28-1988 |
| 5,001,911 | Ram Press for Expressing Liquid from Materials Being Pressed | 03-26-1991 |
| 5,065,535 | Indexing System for Rotary Garment Press | 11-19-1991 |
| 5,331,755 | Ironing Press with Horizontally Rotatable Pressing Members | 07-26-1994 |

TABLE-continued

| PATENT NO. | TITLE | ISSUE DATE MM-DD-YYYY |
|---|---|---|
| 5,970,637 | Automatic Shirt Pressing Apparatus Including a Vacuum System and Associated Method | 10-26-1999 |

The primary structure of a laundry press frame provides a bottom and top plate held together with four posts or rods.

The prior art solid posts or rods are machined to create a top and bottom shoulder and then threaded on both ends. A fastening nut is then applied on the top and bottom.

The life of these posts are known to be compromised because the posts endure a significant amount of bending along with normal loss of preload tension due to wear.

BRIEF SUMMARY OF THE INVENTION

The present invention increases the fatigue life for a laundry press by a factor of 200% to 300%. The design of the present invention includes a spool and specially configured full length tie rod.

In one embodiment, a fastening nut has been designed to have an outer slot in its body. This slot distributes the loading in the nut threads evenly across all threads wherein previous designs the loading is only on the first 1 to 3 threads.

The full length tie rod increases the fatigue by applying a reduced shank profile. The reduced shank allows the tie rod under tension and bending loading to stretch freely in the center instead of stretching where the fastening nut holds the threads of the post.

The present invention provides a press for pressing batches of fabric articles to remove excess fluid therefrom. The apparatus includes a frame having upper and lower plates.

The frame supports a vessel having an interior that is configured to receive a batch of fabric articles therein.

The frame supports a press having a ram and a disk. The disk is supported at the lower end portion of the ram.

The disk is positioned to engage an upper surface portion of the batch of fabric articles that are contained within the vessel interior.

The ram and disk are movable between upper and lower positions, the lower position being a pressing position that engages the disk with the fabric articles.

The frame includes a plurality of rods that connect to the upper and lower plates, spacing the upper and lower plates apart. The rods each have upper and lower end portions, each with a diameter that is larger than the diameter of a central portion of the rod that is positioned in between the upper and lower plates. The central portion is spaced away from each of the plates.

In one embodiment, each rod is attached to the upper and lower plates with a connection that includes a threaded portion of the rod and a nut that connects to the threaded portion.

In one embodiment, the nut has an annular slot.

In one embodiment, the connection includes a preload ring placed in between the nut and a plate.

In one embodiment, each preload ring has a concavity. The nut has a convex portion that registers in the concavity.

In one embodiment, the nut has a load bearing face, a non-load bearing face and a length in between the load bearing face and non-load bearing face. The annular slot is closer to the load bearing face than it is to the non-load bearing face. In one embodiment, the annular slot is spaced from the load bearing face a distance of about ¼ of the length.

In one embodiment, the plates have plate openings that are receptive of rod end portions.

The present invention includes a laundry press apparatus, comprising a frame having upper and lower plates and a plurality of spacer tubes that hold the plates apart, each tube having a tube bore; the frame supporting a vessel, the vessel having an interior that is configured to receive a batch of wetted fabric articles; the frame supporting a press, the press including a ram and a disk supported at the lower end portion of the ram; wherein the disk is positioned to engage an upper surface portion of the batch of articles that is contained within the vessel interior; the ram and the disk being movable between upper and lower positions, the lower position being a pressing position that engages the disk with the fabric articles; the frame including a plurality of rods that extend to the upper and lower plates, the rods each occupying a tube bore, each rod having upper and lower rod end portions; and fasteners that apply tension to each rod and compression to each tube.

Preferably, each rod includes a threaded portion and the fastener includes a nut that connects to the threaded portion.

Preferably, the nut has an annular slot.

Preferably, the fastener includes a preload ring that is placed in between the nut and a plate.

Preferably, each preload ring has a concavity and the nut has a convex portion that registers in a concavity.

Preferably, the nut has a load bearing face, a non-load bearing face and a length in between the load bearing face and the non-load bearing face, wherein the annular slot is closer to the load bearing face than the non-load bearing face.

Preferably, the annular slot is spaced from the load bearing face a distance of about ¼ of the length.

Preferably, the plates have plate openings that are receptive of the rod end portions.

Preferably, each rod has threads that do not connect to a plate.

The present invention includes a laundry press for pressing a batch of fabric articles to remove excess fluid from the articles, comprising a frame having upper and lower plates, each plate having a plurality of plate openings; the frame supporting a vessel having a vessel bottom and side portion and an interior that is configured to contain a batch of fabric articles; a press supporting a ram having upper and lower ram end portions, the ram including a disk supported at the ram lower end portion; wherein the disk is positioned to engage the batch of articles contained within the vessel interior, wherein the disk fits inside of the vessel side portion; the ram and the disk being movable between upper and lower positions, the lower position being a pressing position that engages the disk with the fabric articles; the frame including a plurality of rods that connect to the upper and lower plates at the plate openings, spacing the upper and lower plates apart, the rods each having upper and lower end portions that are at least partially externally threaded, each with a diameter that is larger than the diameter of a central portion of the rod that is positioned in between the upper and lower plates; wherein the central portion is spaced away from each of the plates; and a plurality of nuts that each attach to an externally threaded portion of a rod end portion.

Preferably, each nut has an annular slot.

Preferably, the connection includes a preload ring placed in between the nut and a plate.

The present invention includes a laundry press apparatus, comprising a frame having upper and lower plates; a plurality of spacer tubes that hold the plates apart, each tube having a tube bore; the frame supporting a vessel having an interior that is configured to receive a batch of wetted fabric articles therein that have been laundered; a press having an elongated ram and a disk supported at the lower end portion of the ram; wherein the disk is positioned to engage an upper surface portion of the batch of fabric articles that are contained within the vessel interior; the ram and the disk being movable between upper and lower positions, the lower position being a pressing position that engages the disk with the fabric articles; the frame including a plurality of rods that extend to the upper and lower plates, each of the rods occupying a tube bore, each rod having upper and lower rod end portions; and fasteners that apply tension to each rod and wherein each tube is in compression when each rod is tensioned.

Preferably, each rod includes a threaded end portion and each fastener includes a nut that connects to a threaded end portion.

Preferably, the fastener includes a preload ring that is positioned in between a nut and a plate.

The present invention includes a press for pressing batches of fabric articles to remove excess fluid therefrom, comprising: a frame having upper and lower plates, each plate having a plurality of plate openings; the frame supporting a vessel having an interior that is configured to receive a batch of fabric articles therein; a press having a ram and a disk supported at the lower end portion of the ram; wherein the disk is positioned to engage an upper surface portion of the batch of articles that are contained within the vessel interior; the ram and the disk being movable between upper and lower positions, the lower position being a pressing position that engages the disk with the fabric articles, compressing the fabric articles in between the disk and the vessel; the frame including a plurality of rods that connect to the upper and lower plates at the plate openings, spacing the upper and lower plates apart, the rods each having upper and lower end portions that are at least partially externally threaded, each with a diameter that is larger than the diameter of a central portion of the rod that is positioned in between the upper and lower plates; wherein the central portion is spaced away from each of the plates; and a plurality of nuts that each attach to an externally threaded portion of a rod end portion.

Preferably, each nut has an annular groove.

Preferably, the connection includes a ring that is placed in between the nut and a plate.

Preferably, each ring has a concavity and the nut has a convex portion that registers in a concavity.

Preferably, the nut has a load bearing face, a non-load bearing face and a length in between the load bearing face and the non-load bearing face, wherein the annular groove is closer to the load bearing face than the non-load bearing face.

Preferably, the annular groove is spaced from the load bearing face a distance of about ¼ of the length.

A press for pressing batches of fabric articles to remove excess fluid therefrom utilizes a specially configured frame having upper and lower plates. The frame supports a vessel having an interior that is configured to receive a batch of fabric articles therein. A press having a ram and a disk is supported at the lower end portion of the ram. The disk is positioned to engage an upper surface portion of the batch of articles that are contained within the vessel interior. The ram and disk are movable between upper and lower positions, the lower position being a pressing position that engages the disk with the fabric articles. The frame includes a plurality of rods that connect to the upper and lower plates, spacing the upper and lower plates apart. The rods each have upper and lower end portions, each with a diameter that is larger than the diameter of a central portion of said rod that is positioned in between the upper and lower plates. The central portion is spaced away from each of the plates.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 7:
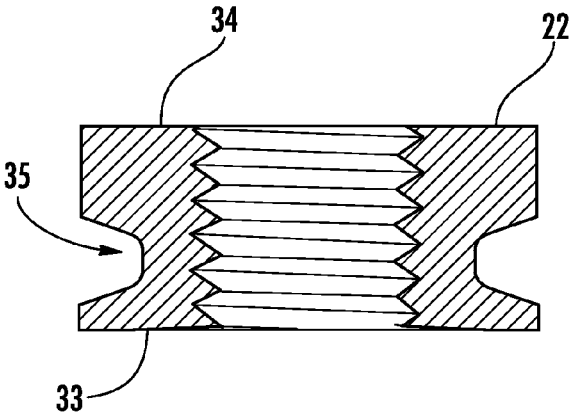
FIG. 7 is a partial sectional view of a preferred embodiment of the apparatus of the present invention showing a close up of the nut.
Figure 8:
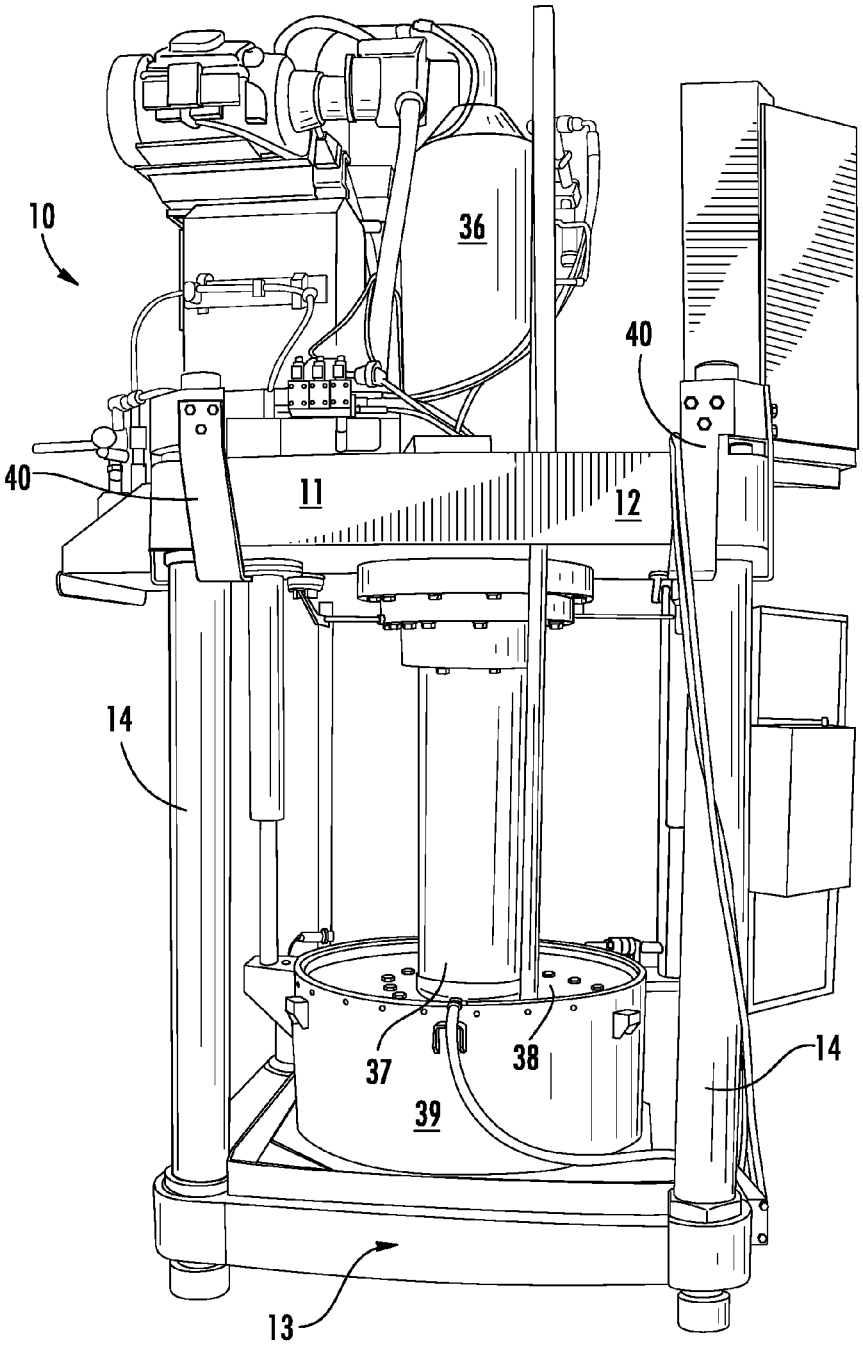
FIG. 8 is a perspective view of a preferred embodiment of the apparatus of the present invention.
Figure 9:
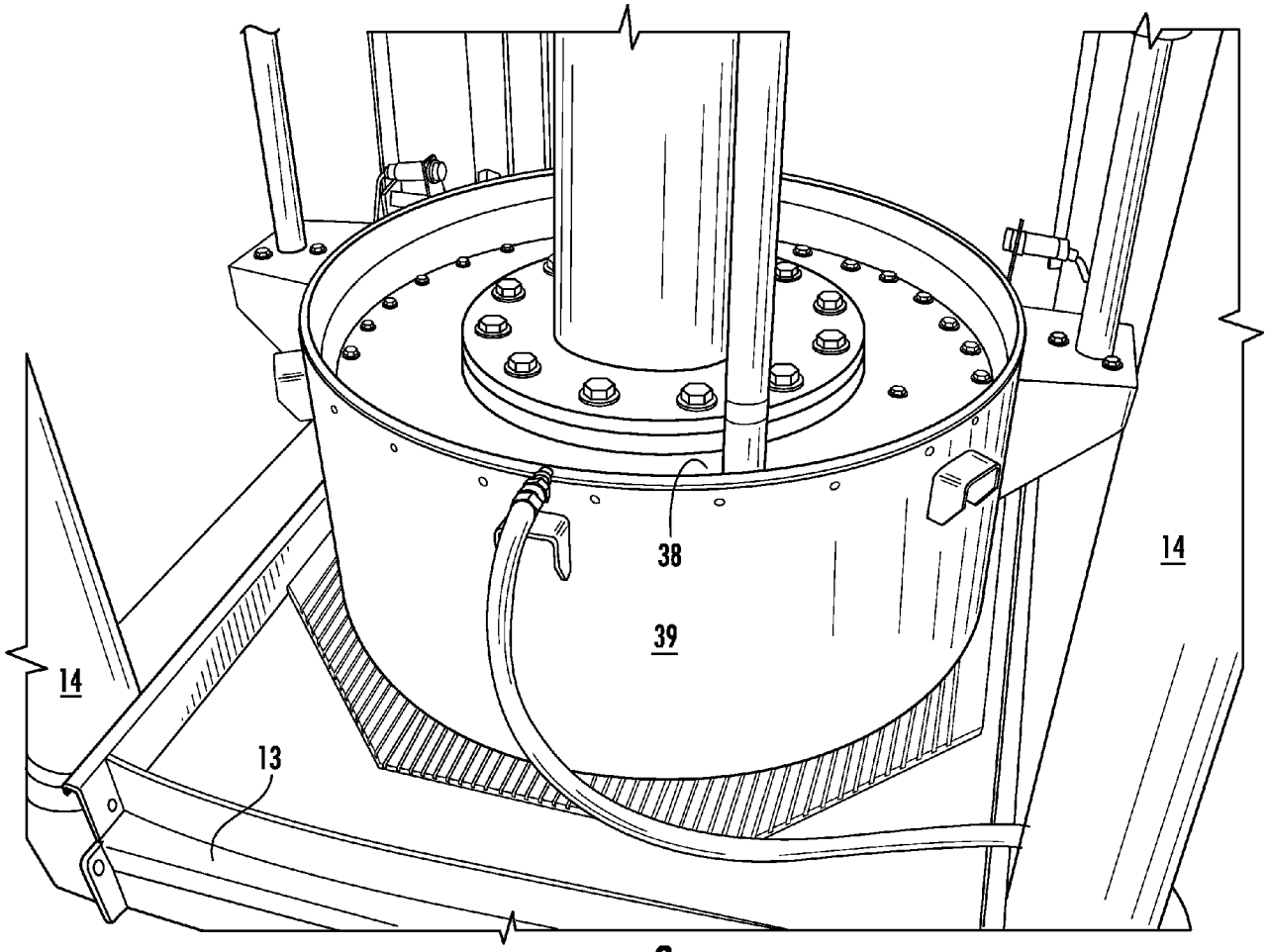
FIG. 9 is a partial perspective view of a preferred embodiment of the apparatus of the present invention.
Figure 14:
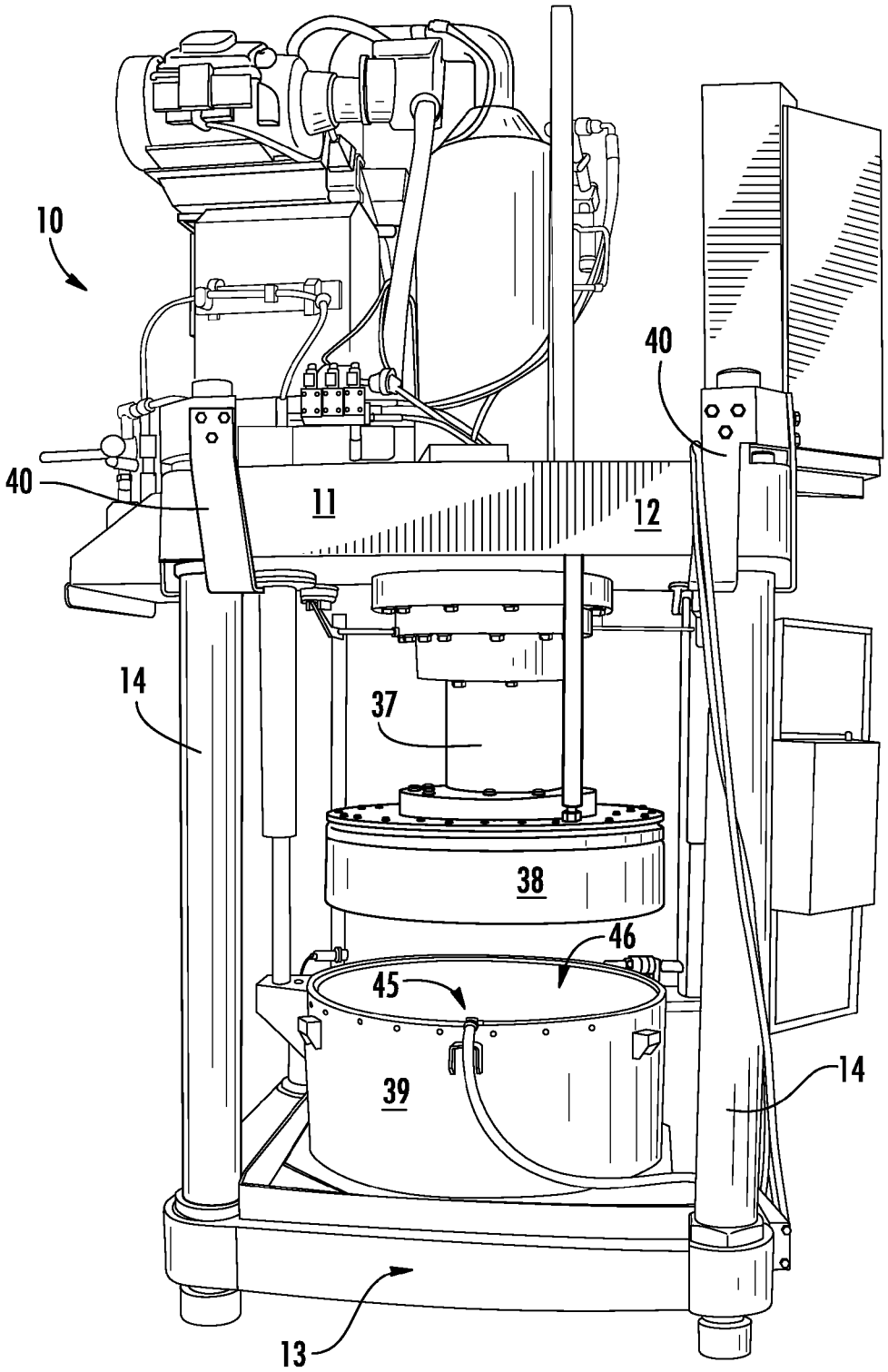
FIG. 14 is a perspective view of a preferred embodiment of the apparatus of the present invention.

FIGS. 1-14 show a preferred embodiment of the apparatus of the present invention, designated generally by the numeral 10 in FIGS. 8 and 14. The present invention provides a press 10 for pressing batches of fabric articles to remove excess fluid therefrom. In FIGS. 8-9, press 10 employs a pressure cylinder 36 (e.g., hydraulic cylinder) mounted to a machine frame 11. A piston rod or push rod 37 extends downwardly from the pressure cylinder 36, supporting a ram 38 that engages the batch of fabric articles which are contained in a shell or vessel 39.

Figure 1A:
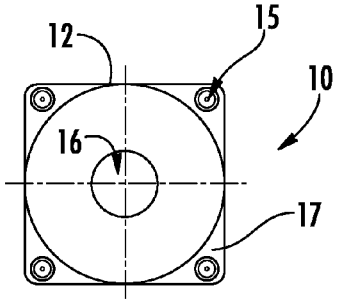
FIGS. 1A-1B are a partial top view and a side view of a preferred embodiment of the apparatus of the present invention.
Figure 1B:
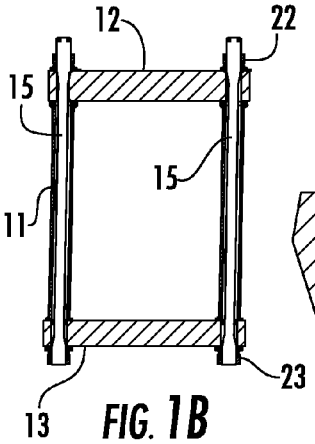
Figure 2:
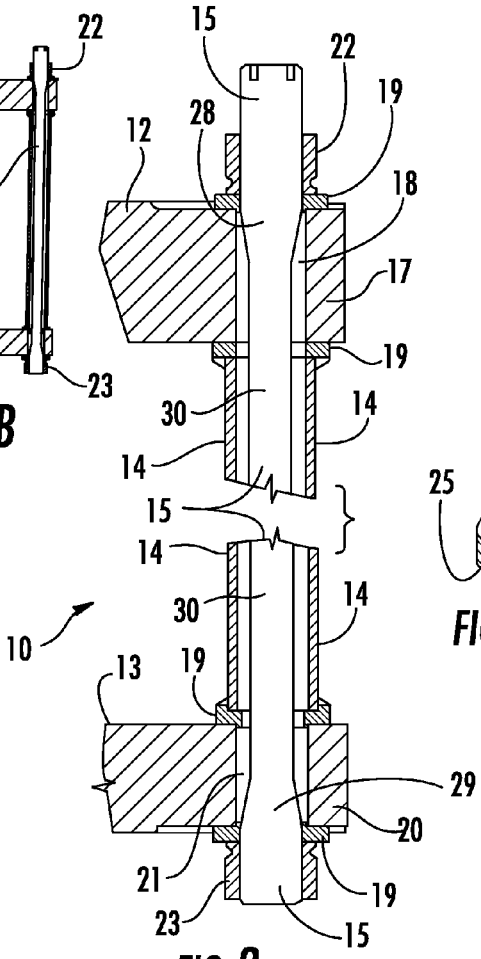
FIG. 2 is a partial sectional elevation view of a preferred embodiment of the apparatus of the present invention showing the press in an upper position.

An example of a prior art apparatus that employs a pressure cylinder, frame, ram, shell and batch of fabric articles can be seen in FIGS. 1 and 2 of U.S. Pat. No. 5,001,911 (911 patent) entitled "RAM Press for Expressing Liquid from Materials Being Pressed". It should be understood that prior art ram presses for extracting fluid from fabric articles (such as seen in the '911 patent) are commercially available.

The present invention provides an improvement to the frame 11 that supports the pressure cylinder 36, pushrod 37, ram 38, and the batch of articles 46 to be pressed with water. The apparatus 10 and the improved frame 11 can be seen in FIGS. 1-7 in more detail.

FIGS. 1A-B, 2 and 8-14 illustrate the frame 11 comprised of top plate 12, bottom plate 13, multiple spacers or spools 14, each housing a reduced shank tie rod 15, and fastening nuts 22, 23 which can be slotted fastening nuts.

Figure 3:
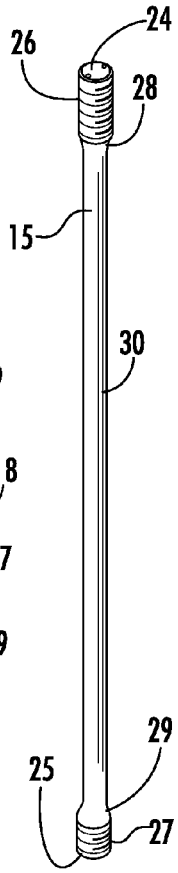
FIG. 3 is a partial perspective view of a preferred embodiment of the apparatus of the present invention showing the rod portion.

FIGS. 2-3 illustrate the reduce shank tie rod 15 in more detail. Generally the length of the tie rod 15 can be between about 15 and 150 inches (38 and 381 cm). The threaded section 26, 27 length on top and bottom can be 12 to 24 inches (30 and 61 cm) with a diameter of between about 3 and 12 inches (8 and 30 cm). The reduced shank 30 is generally with a diameter of between about 2 and 10 inches (5 and 25 cm) depending on the diameter of the threaded sections 26, 27. The reduced diameter shank 30 will always have a diameter smaller than the diameter of sections 26, 27.

The assembly shown in FIGS. 1A-1B and 2 is performed by stretching the tie rod 15 approximately 1/16" to 1/2" (0.16 cm to 1.27 cm) creating the preload which withstands the force of the hydraulic pressure when removing water from the fabric articles or linen.

The laundry press apparatus 10 thus employs a frame 11 having a top plate or head 12 and a bottom plate 13. The bottom plate 13 can be provided with openings, slots or bores through which water can escape.

A vessel, shell or other container 39 for holding a batch of fabric articles rests upon the bottom plate 13. Vessel or shell 39 has interior 45 that holds or contains fabric articles 46 to be pressed of excess fluid. The top plate 12 supports a pressure cylinder such as a hydraulic cylinder 36 having a push rod 37 and a ram 38 that engages the fabric articles which care contained within shell or vessel 39. The pressure cylinder 36 could typically extend above the top plate 12. The top plate 12 provides an opening 16 through which the pushrod or piston rod 37 of the pressure cylinder 36 extends. The ram 38 would be positioned in between the plates 12, 13 (see FIGS. 8 and 14). Each of the top 12 and bottom 13 plates provides four corners, each corner having a rod 15 that is attached to both a top plate 12 and bottom plate 13.

Figure 4:
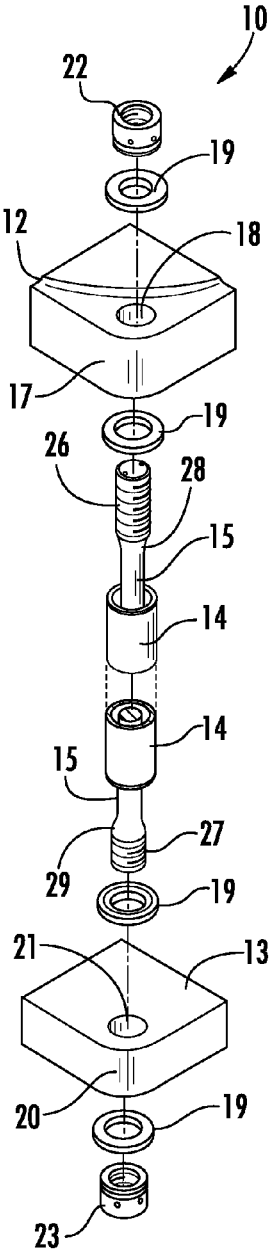
FIG. 4 is a partial perspective exploded view of a preferred embodiment of the apparatus of the present invention.

FIGS. 2-4 show more particularly the construction of rod 15 and a spacer or spool 14 that extends around each rod 15 as shown. In FIGS. 2 and 4, a corner 17 is shown for each connection between a rod 15 and top plate 12. FIGS. 2 and 4 also show a connection between a corner 20 of a bottom plate 13. Corner 17 of top plate 12 provides a corner opening 18. Corner 20 of bottom plate 13 provides an opening 21.

Each rod 15 has a rod upper end 24 and a rod lower end 25. The rod upper end 24 provides a larger diameter threaded section 26. The rod lower end 25 provides a larger diameter threaded section 27.

Each rod 15 has a reduced diameter section 30. A tapered or transition section 28, 29 is provided in between the rod reduced diameter section 30 and a larger diameter threaded section 26 or 27. In FIGS. 2-4, tapered or transitioned section 28 is a tapered section or transition between reduced diameter section 30 and larger diameter threaded section 26.

Similarly, a tapered or transition section 29 is provided in between reduced diameter section 30 and larger diameter threaded section 27.

An upper nut 22 forms a threaded connection with the larger diameter threaded section 26. Similarly, nut 23 forms a threaded connection with larger diameter threaded section 27. Washer 19 is placed in between top plate 12 and nut 22. Similarly, a washer 19 is placed in between nut 23 and bottom plate 13. Spacer or spool 14 surrounds rod 15 as shown in FIGS. 1B-4. A washer 19 can be placed in between spacer or spool 14 and top plate 12. Similarly, a washer 19 can be placed in between spacer or spool 14 and bottom plate 13 (See FIGS. 2 and 4). FIG. 2 shows that the tapered or transition section 28 extends below the connection between nut 22 and top plate 12. Similarly, the transition or tapered section 29 extends above the connection of nut 23 to bottom plate 13.

Figure 5:
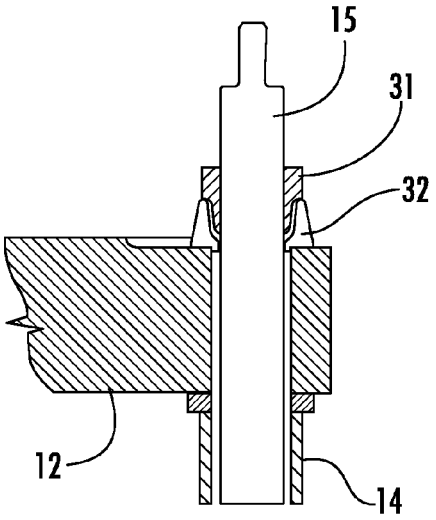
FIG. 5 is a partial sectional view of a preferred embodiment of the apparatus of the present invention showing a modified upper joint.
Figure 6:
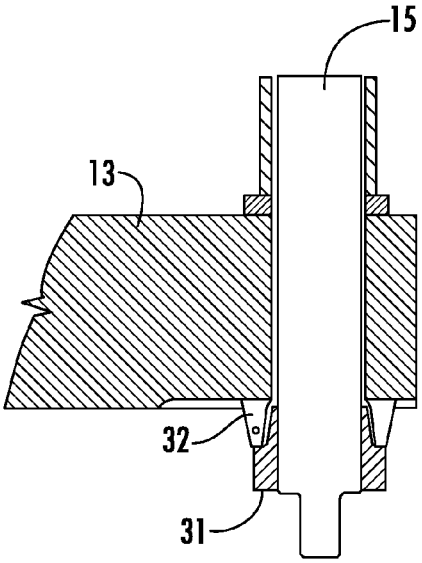
FIG. 6 is a partial sectional view of a preferred embodiment of the apparatus of the present invention showing a modified lower joint.

FIG. 5 shows a modified upper joint wherein a tension nut 31 nests in a modified annular member or preload ring 32 which rests against the upper surface of upper plate 12. Nut 31 would be internally threaded to connect with external threads on an end portion of rod 15. A similar connection could be provided in between lower plate 13 and rod 15 as shown in FIG. 6.

FIG. 7 shows a close up view of nut 22 which has a loading face 33 and an opposing face 34. In FIG. 7, annular groove 35 is closer to the loading face 33 when compared to the opposing face 34 as shown. The groove 35 could be about ¼ of the distance between the loading face 33 and the opposing face 34, being closer to the loading face 33 as shown in FIG. 7. Nut 23 could be constructed the same as nut 22 of FIG. 7. Nuts 22, 23 can have outer flats (e.g., hexagonal shape) so that the nuts can be rotated with a wrench or power tool. Nut 22 (or 23) can have openings 47 that are receptive of a tool that could rotate the nut 22 or 23 (See FIG. 13).

Figure 10:
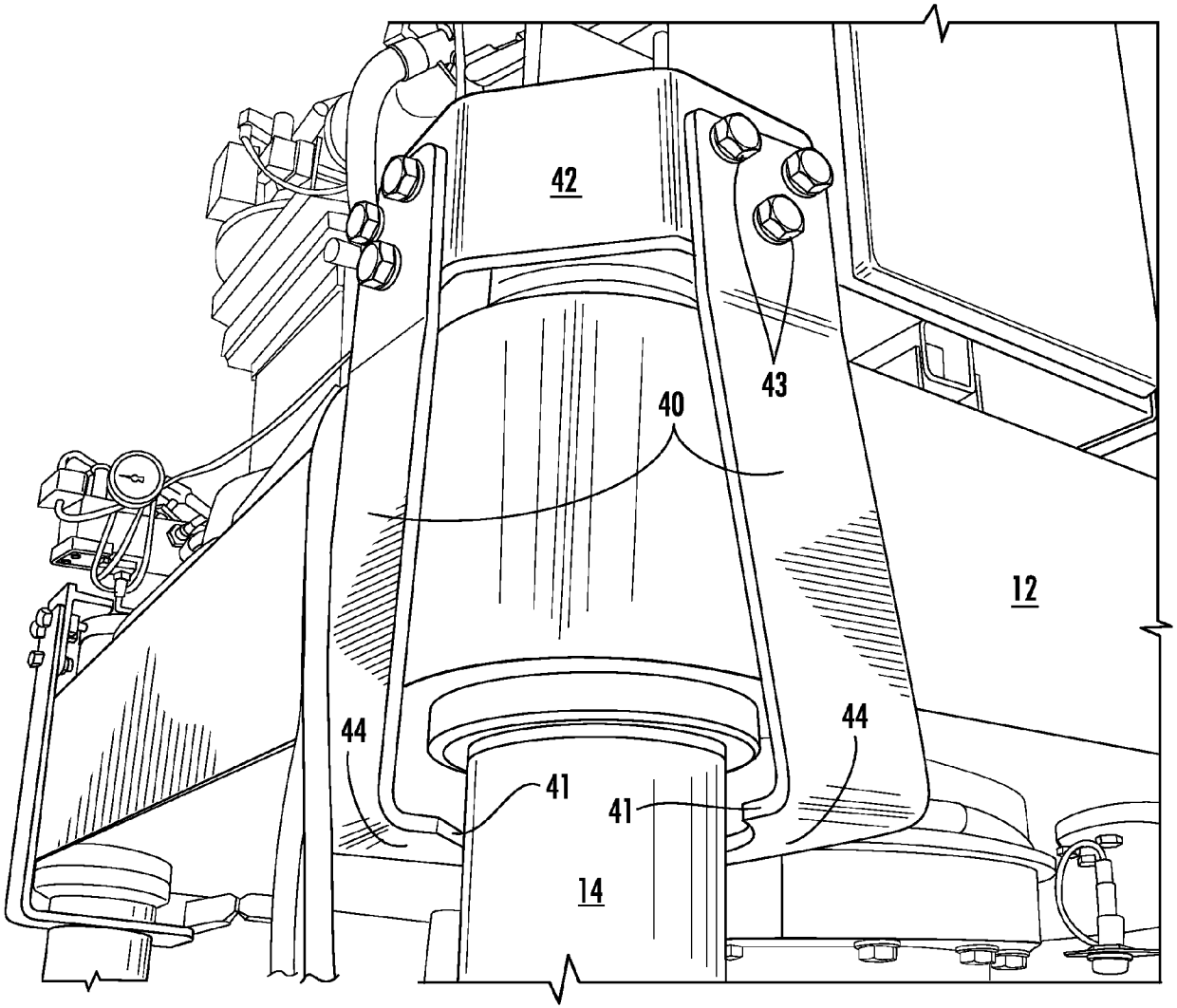
FIG. 10 is a partial perspective view of a preferred embodiment of the apparatus of the present invention.
Figure 11:
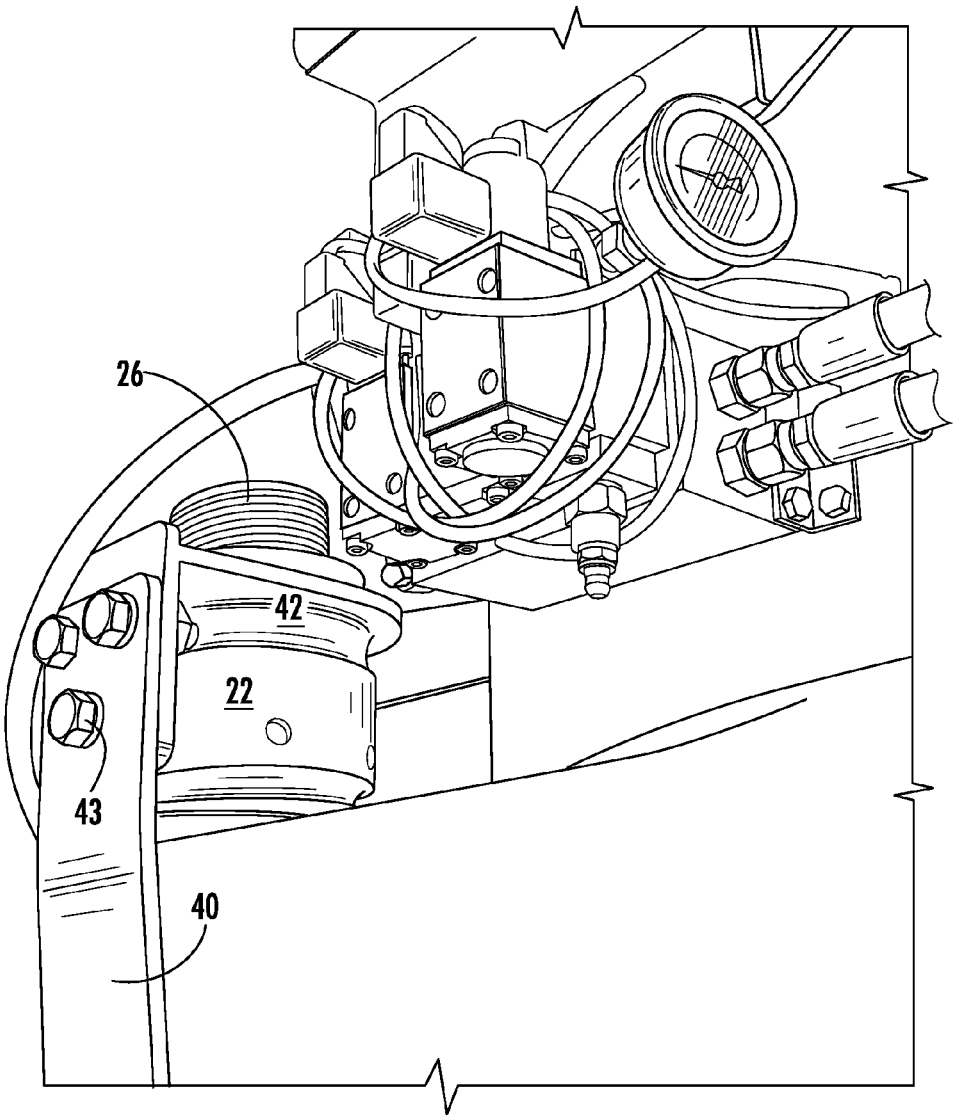
FIG. 11 is a partial perspective view of a preferred embodiment of the apparatus of the present invention.
Figure 12:
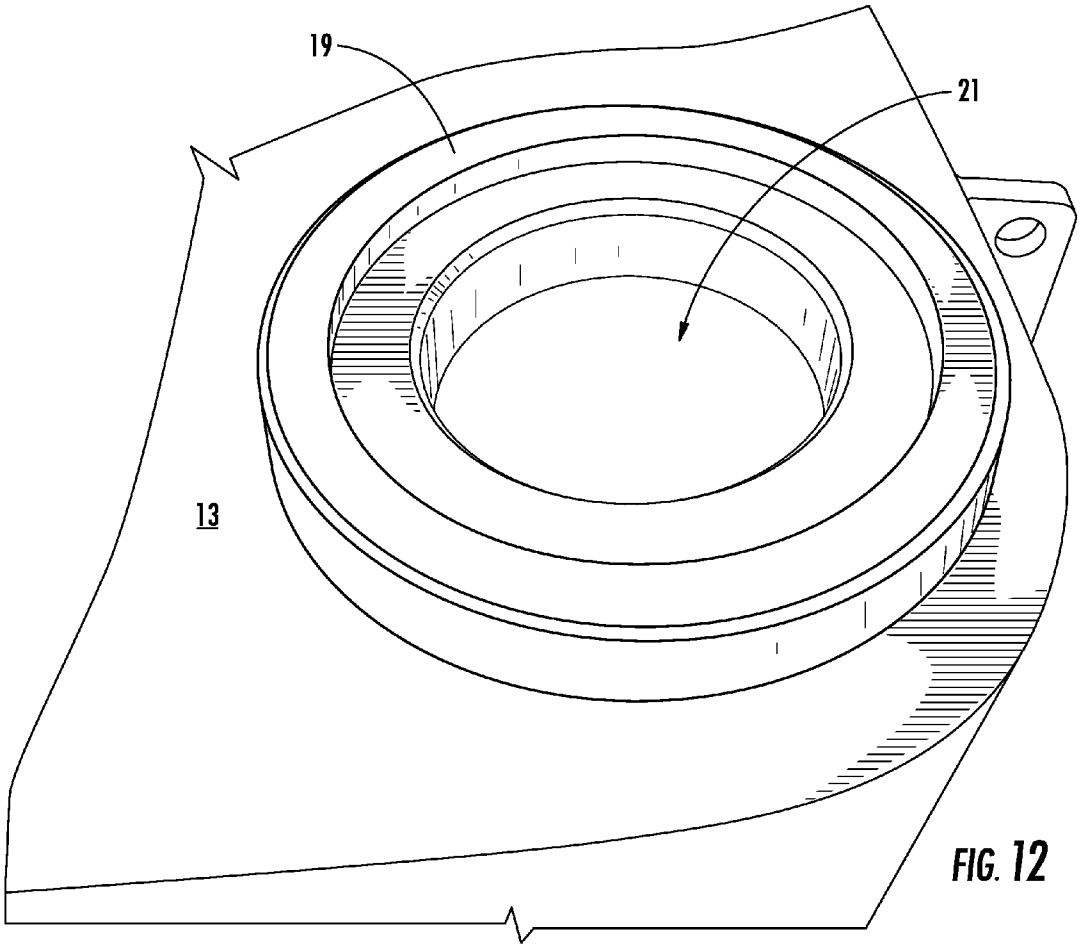
FIG. 12 is a partial perspective view of a preferred embodiment of the apparatus of the present invention.
Figure 13:
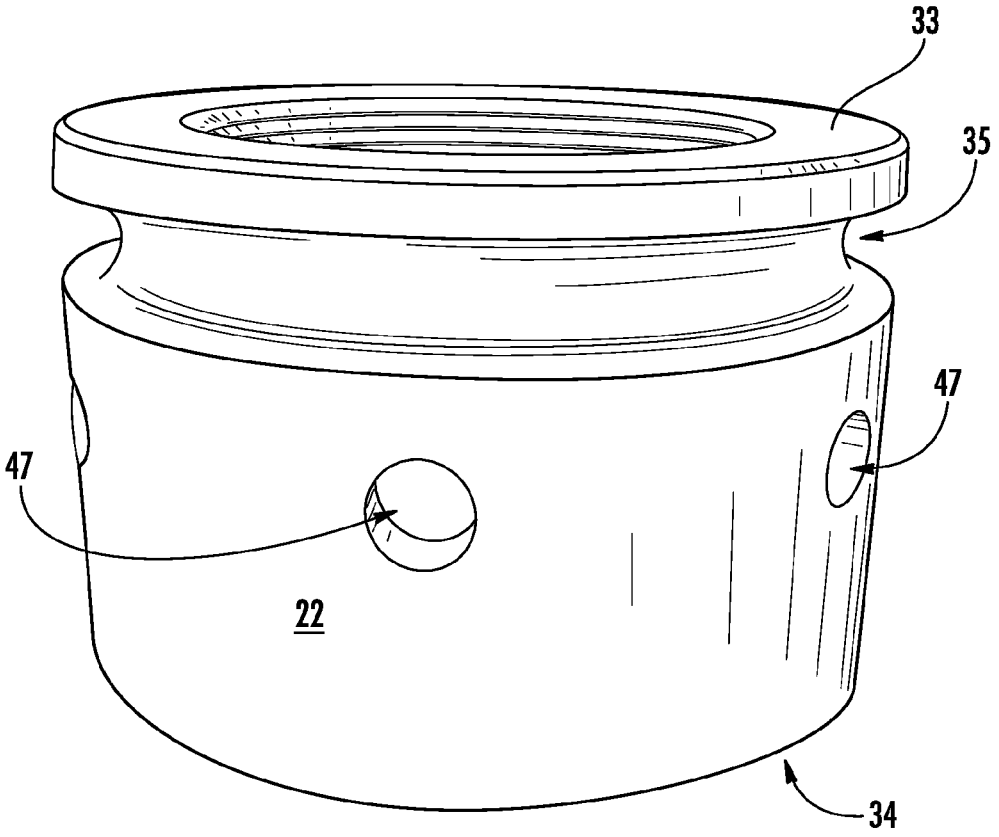
FIG. 13 is a partial perspective view of a preferred embodiment of the apparatus of the present invention.

FIGS. 8 and 10-11 show retainer 40 which can be used to retain parts of any rod 15 that has failed (e.g., broken into pieces) during use. The retainer 40 includes a fitting 42 having internal threads that mate with the external threads 26 of a rod 15. Fitting 42 is placed above nut 22 and threadably attached to threaded section 26. A pair of flanges 41 are attached to fitting 42 using bolted connections 43. The flanges 41 have horizontally extending portions 44 that extend under top plate 12 as seen in FIG. 10. If a rod 15 in tension fails, retainer 40 prevents an upper end of the rod 15 from traveling upwardly, becoming a projectile and possibly causing damage or injury.

The following is a list of parts and materials suitable for use in the present invention.

PARTS LIST

| Part Number | Description |
|---|---|
| 10 | laundry press apparatus |
| 11 | frame |
| 12 | top plate |
| 13 | bottom plate |
| 14 | spacer/spool |
| 15 | rod |
| 16 | central opening |
| 17 | corner |
| 18 | corner opening |
| 19 | washer |
| 20 | corner |
| 21 | corner opening |
| 22 | nut, upper |

-continued

PARTS LIST

| Part Number | Description |
|---|---|
| 23 | nut, lower |
| 24 | rod upper end |
| 25 | rod lower end |
| 26 | larger diameter threaded section |
| 27 | larger diameter threaded section |
| 28 | tapered/transition section |
| 29 | tapered/transition section |
| 30 | reduced diameter section/shank |
| 31 | tension nut |
| 32 | modified preload ring |
| 33 | loading face |
| 34 | opposing face |
| 35 | annular groove |
| 36 | hydraulic cylinder |
| 37 | push rod/piston rod |
| 38 | ram |
| 39 | shell/vessel |
| 40 | retainer |
| 41 | flange |
| 42 | fitting |
| 43 | bolted connection |
| 44 | horizontally extending portion |
| 45 | shell interior |
| 46 | fabric articles |
| 47 | opening |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A laundry press for pressing a batch of fabric articles to remove excess fluid from the articles, comprising:

a) a frame having upper and lower plates, each plate having a plate upper surface, a plate lower surface and a plurality of plate openings that each extend from said upper to said lower plate surface;

b) the frame supporting a vessel having a vessel bottom and side portion and an interior that is configured to contain a batch of fabric articles;

c) a press supporting a ram having upper and lower ram end portions, the ram including a disk supported at the ram lower end portion;

d) wherein the disk is positioned to engage the batch of articles contained within the vessel interior, wherein the disk fits inside of the vessel side portion;

e) the ram and the disk being movable between upper and lower positions, the lower position being a pressing position that engages the disk with the fabric articles;

f) the frame including a plurality of hollow spacers, each spacer having a hollow spacer bore and a spacer wall surrounding said bore, wherein said spacer wall engages the upper plate lower surface and the lower plate upper surface;

g) a plurality of rods that extend to and through the upper and lower plates at said plate openings, wherein each said rod occupies said spacer hollow bore, and wherein the spacers and rods space the upper and lower plates apart;

h) each rod having upper and lower larger diameter end portions that are at least partially externally threaded and a rod central portion that is in between the large diameter end portions, each rod larger diameter end portion larger than the diameter of the rod central portion;

i) a tapered transition portion that joins each larger diameter end portion to the rod central portion, said transition portion positioned in a said plate opening;

j) wherein the central rod portion is contained entirely within said spacer hollow bore and spaced inwardly away from each of the plates; and k) a plurality of nuts that each attach to a said externally threaded portion of a rod end portion, wherein a tightening of a said nut enables a tensioning of a said rod and a compressing of a said hollow spacer.

2. The press of claim 1, wherein each nut has an annular slot.

3. The press of claim 1, wherein the connection includes a preload ring placed in between said nut and a said plate.

4. The press of claim 3 wherein each preload ring has a concavity and the nut has a convex portion that registers in a said concavity.

5. The press of claim 2, wherein the nut has a load bearing face, a non-load bearing face and a length in between the load bearing face and the non-load bearing face, wherein the annular slot is closer to the load bearing face than the non-load bearing face.

6. The press of claim 5 wherein the annular slot is spaced from the load bearing face a distance of about ¼ of said length.

7. A laundry press apparatus, comprising:

a) a frame having upper and lower plates, each plate having an upper surface and a lower surface;

b) multiple open ended plate openings that each extend to said upper and lower surfaces:

c) the frame including a plurality of spacer tubes that hold the plates apart, each spacer tube having a tube bore, each spacer tube having an upper end that engages the lower surface of the upper plate and a lower end that engages the upper surface of the lower plate;

d) the frame supporting a vessel having an interior that is configured to receive a batch of wetted fabric articles therein that have been laundered;

e) a press having an elongated ram and a disk supported at the lower end portion of the ram;

f) wherein the disk is positioned to engage an upper surface portion of the batch of fabric articles that are contained within the vessel interior;

g) the ram and the disk being movable between upper and lower positions, the lower position being a pressing position that engages the disk with the fabric articles;

h) the frame including a plurality of rods that extend to the upper and lower plates and through a said plate opening, each of said rods occupying a said tube bore, each rod having upper and lower rod end portions having a larger diameter;

i) wherein the rod upper end portion extends above the upper plate upper surface and the rod lower end extends below the lower plate lower surface;

j) each rod having a smaller diameter central portion contained entirely within said tube bore and positioned in between said larger diameter end portions;

k) fasteners that enable tension to be applied to each rod and wherein each tube is in compression when each rod is tensioned by said application of tension; and l) wherein each said rod has a tapered section in between the larger diameter end portion and the smaller diameter central portion, said tapered section occupying a said plate opening.

8. The press of claim 7, wherein each rod includes a threaded end portion and each fastener includes a nut that connects to a said threaded end portion.

9. The press of claim 8, wherein the nut has an annular slot.

10. The press of claim 8, wherein the fastener includes a preload ring that is positioned in between a said nut and a said plate.

11. The press of claim 10 wherein each preload ring has a concavity and the nut has a convex portion that registers in a said concavity.

12. The press of claim 9, wherein the nut has a load bearing face, a non-load bearing face and a length in between the load bearing face and the non-load bearing face, wherein the annular slot is closer to the load bearing face than the non-load bearing face.

13. The press of claim 12 wherein the annular slot is spaced from the load bearing face a distance of about ¼ of said length.

14. The press of claim 7 wherein the plates have plate openings that are receptive of said rod end portions.

15. The press of said claim 7 wherein each rod has threads that do not connect to a said plate.

16. A press for pressing batches of fabric articles to remove excess fluid therefrom, comprising:

a) a frame having upper and lower plates, each plate having a plurality of open ended plate openings;

b) the frame supporting a vessel having an interior that is configured to receive a batch of fabric articles therein;

c) a press having a ram and a disk supported at the lower end portion of the ram;

d) wherein the disk is positioned to engage an upper surface portion of a said batch of articles that are contained within the vessel interior;

e) the ram and the disk being movable between upper and lower positions, the lower position being a pressing position that engages the disk with the fabric articles, compressing the fabric articles in between the disk and the vessel;

f) the frame including a plurality of rods and hollow tubes;

g) wherein each tube connects to the upper and lower plates next to said plate openings, said hollow tubes spacing the upper and lower plates apart, said rods each having a smaller rod diameter central portion in between upper and lower larger diameter rod end portions that are at least partially externally threaded, each said larger diameter rod end portion having a diameter that is larger than the diameter of the rod central portion;

h) wherein the central rod portion is spaced inwardly and away from each of the plates;

i) a plurality of nuts that each attach to an externally threaded portion of a rod larger diameter end portion, wherein a tightening of a said nut enables a tensioning of a said rod and a compressing of a said tube;

j) wherein each tube has a tube bore and said central rod portion is entirely contained in said tube bore; and k) each rod having a tapered section in between the central rod portion and the rod larger diameter end portion, said tapered section occupying a said open ended plate opening.

17. The press of claim 16, wherein each nut has an annular groove.

18. The press of claim 16, wherein the connection includes a ring that is placed in between a said nut and a said plate.

19. The press of claim 18 wherein each ring has a concavity and the nut has a convex portion that registers in a said concavity.

20. The press of claim 17, wherein the nut has a load bearing face, a non-load bearing face and a length in between the load bearing face and the non-load bearing face, wherein the annular groove is closer to the load bearing face than the non-load bearing face.

21. The press of claim 20 wherein the annular groove is spaced from the load bearing face a distance of about ¼ of said length.

22. A laundry press apparatus for pressing a batch of fabric articles to remove excess fluid from the articles comprising:

a) a frame having upper and lower plates, each plate having a plurality of plate openings;
b) the frame supporting a vessel having a vessel bottom and side portion and an interior that is configured to contain a batch of fabric articles;
c) a press supporting a ram having upper and lower ram end portions, the ram including a disk supported at the ram lower end portion;
d) wherein the disk is positioned to engage the batch of articles contained within the vessel interior, wherein the disk fits inside of the vessel side portion;
e) the ram and the disk being movable between upper and lower positions, the lower position being a pressing position that engages the disk with the fabric articles;
f) the frame including a plurality of rods and tubes that connect to the upper and lower plates at said plate openings, the tubes spacing the upper and lower plates apart, said rods each having upper and lower end portions that are at least partially externally threaded, each with a diameter that is larger than the diameter of a central portion of said rod that is positioned in between the upper and lower plates;
g) wherein the central portion is spaced inwardly away from each of the plates;
h) a plurality of nuts that each attach to an externally threaded portion of a rod end portion, wherein attachment of said nuts to said rods places the rods in tension and the tubes in compression;
i) wherein each tube has a tube bore and said central rod portion is entirely contained in said tube bore; and
j) each rod having a tapered section in between the central rod portion and the rod larger diameter end portion, said tapered section occupying a said open ended plate opening.

23. The laundry press apparatus of claim 22, wherein each nut has an annular slot.

24. The laundry press apparatus of claim 23, wherein each rod includes a threaded end portion and each fastener includes a nut that connects to a said threaded end portion.

25. The laundry press apparatus of claim 22 wherein each rod has threads that do not connect to a said plate.

26. A laundry press apparatus, comprising:

a) a frame having upper and lower plates and a plurality of spacer tubes that hold the plates apart, each tube having a tube bore;
b) multiple plate openings that each extend through a said plate including openings in both upper and lower plates;
c) the frame supporting a vessel, said vessel having an interior that is configured to receive a batch of wetted fabric articles;
d) the frame supporting a press, the press including a ram and a disk supported at the lower end portion of the ram;
e) wherein the disk is positioned to engage an upper surface portion of the batch of articles that is contained within the vessel interior;
f) the ram and the disk being movable between upper and lower positions, the lower position being a pressing position that engages the disk with the fabric articles;
g) the frame including a plurality of rods that extend to the upper and lower plates, said rods occupying a said tube bore, each rod having upper and lower rod end portions;
h) wherein the upper and lower end portions of each rod have a diameter that is larger than a diameter of a central portion of the rod that is positioned in between the upper and lower plates;
i) fasteners are provided that apply tension to each rod and compression to each tube at a position spaced away from said central portion of the rod;
j) wherein each tube has a tube bore and said central rod portion is entirely contained in said tube bore; and
k) each rod having a tapered section in between the central rod portion and the rod larger diameter end portion, said tapered section occupying a said open ended plate opening.

27. The press of claim 26 wherein:

a) each plate has a plurality of plate openings;
b) the vessel has a vessel bottom and side portion;
c) the ram has upper and lower ram end portions, the disk supported at the ram lower end portion;
d) the disk fits inside of the vessel side portion;
e) the plurality of rods connect to the upper and lower plates at said plate openings, spacing the upper and lower plates apart, the upper and lower end portions of each rod being at least partially externally threaded;
f) the central portion of each rod is spaced away from each of the plates; and
g) the fasteners include a plurality of nuts that each attach to an externally threaded portion of a rod end portion.

28. The press of claim 26 wherein:

a) each plate has a plurality of plate openings;
b) the lower position of the ram and the disk being a pressing position that engages the disk with the fabric articles, compressing the fabric articles in between the disk and the vessel;
c) the plurality of rods connect to the upper and lower plates at said plate openings, spacing the upper and lower plates apart, the upper and lower end portions of each rod being at least partially externally threaded;
d) the central portion of each rod is spaced away from each of the plates; and
e) the fasteners include a plurality of nuts that each attach to an externally threaded portion of a rod end portion.

29. The press of claim 28, wherein each nut has an annular groove.

30. The press of claim 29 wherein each rod includes a threaded portion and the fastener includes a nut that connects to said threaded portion.

31. The press of claim 28, wherein each rod has threads that do not connect to a said plate.

* * * * *